US005361512A

United States Patent [19]

Tobiason

[11] Patent Number: 5,361,512

[45] Date of Patent: Nov. 8, 1994

[54] SYSTEM FOR APPLYING HERBICIDES TO FLORA INFESTATIONS WITHIN SEWER LINES

[75] Inventor: Timothy W. Tobiason, Silver Creek, Nebr.

[73] Assignee: General Chemical Co., Salem, Oreg.

[21] Appl. No.: 919,441

[22] Filed: Jul. 27, 1992

[51] Int. Cl.[5] ..... F26B 25/00

[52] U.S. Cl. ..... 34/60; 34/220; 34/104

[58] Field of Search ..... 34/242, 22, 218, 12, 34/60, 220, 104; 237/13; 15/104.31

[56] References Cited

U.S. PATENT DOCUMENTS 261,081 7/1882 Comstock et al. ..... 237/13

*Primary Examiner*—Henry A. Bennett

*Attorney, Agent, or Firm*—Sean Patrick Suiter

[57] ABSTRACT

A method and apparatus for applying herbicide to the interior of sewer lines. The invention includes a heating assembly which is capable of raising the temperature of the herbicide such that it enters a gaseous state. This gaseous herbicide is then forced through flexible tubing and into the sewer line where it attacks flora infestations therein. A highly saturated atmosphere is maintained within the sewer line by a pair of inflatable inner-tube type devices which entrap the gaseous herbicide within the area of sewer line to be treated.

5 Claims, 4 Drawing Sheets

SYSTEM FOR APPLYING HERBICIDES TO FLORA INFESTATIONS WITHIN SEWER LINES

TECHNICAL FIELD

This invention relates to the application of herbicides within drains and sewer lines, and more particularly to the use of a vaporized herbicide which will permeate a sewer line and kill the flora infestations therein.

BACKGROUND ART

The flora infestation of sewer lines has long been a serious problem. After sewer lines have been laid, they often develop leaks around the joints due to settling of the ground, earthquakes, or vibration of the earth due to traffic roadways. These areas of leakage are then often penetrated by roots, which in time can clog or rupture the sewer line. Once this has occurred, the sewer line must be removed and replaced. This replacement is not only very expensive, but also destroys the surrounding flora.

In order to prevent flora damage to sewer lines, various herbicides have been used as have various application methods. The most common method of attacking flora infestations within sewer lines is by flushing a herbicide such as copper surf ate through the line. This method is only partially effective since only the flora in the lower, fluid carrying portion of the line is treated while flora in the upper portion of the line remains untreated. Also known to the art are chemically foaming mixtures which produce foam in the presence of sewer water in order to carry the herbicide throughout the interior of the line. While this method is more effective, it is also quite expensive and requires the use of a large amount of herbicide.

DISCLOSURE OF THE INVENTION

The present invention discloses an apparatus and a method for the application of herbicides to sewer line interiors. The apparatus includes a heating assembly which heats a herbicide until it reaches a gaseous state. This gas is then forced through flexible tubing and into the sewer line by means of a blower assembly. To enhance the effectiveness of the herbicide, the sewer line may be partially blocked by means of inflatable devices inserted into the lines. The effect is to entrap the atmosphere within the sewer line enabling the gaseous herbicide to reach a higher concentration and thereby more effectively attack the flora infestations.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
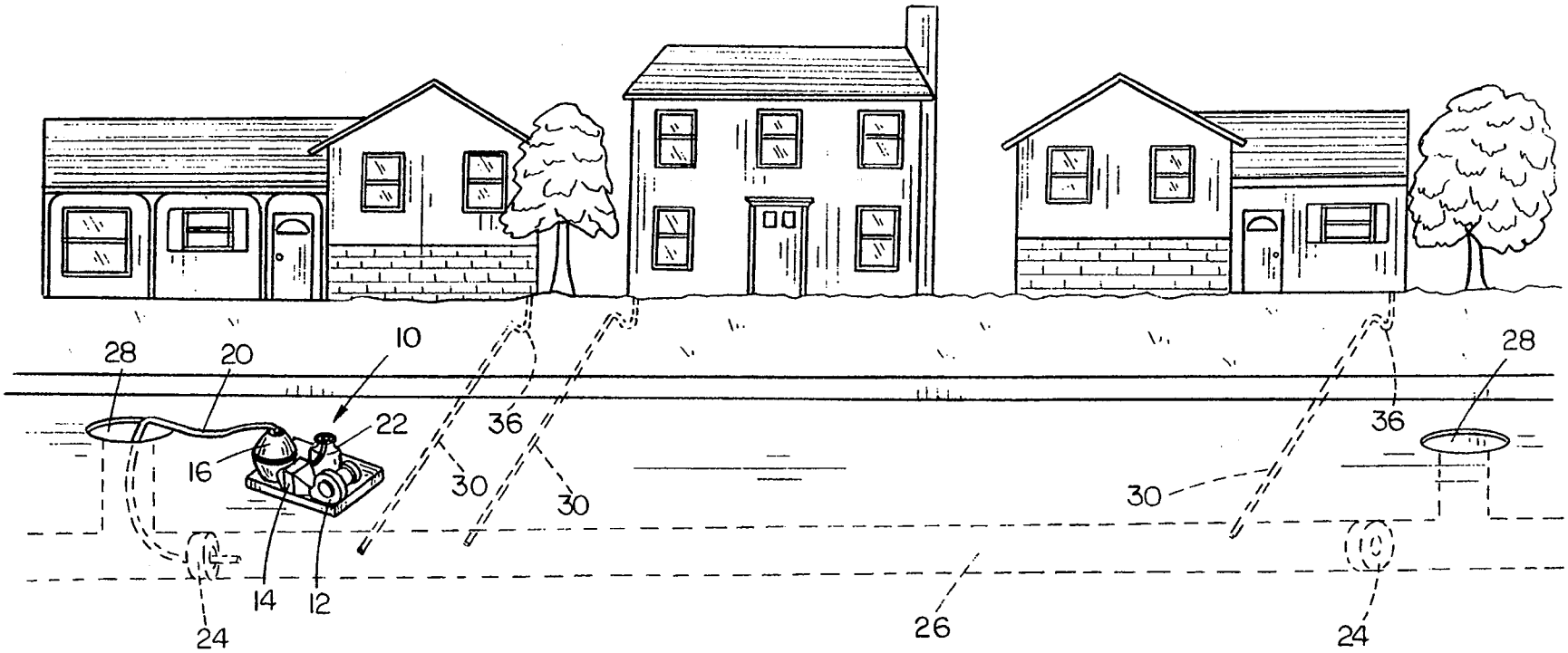
FIG. 1 depicts a typical residential sewer line network with the present invention in use.

A preferred embodiment of the present invention (10) is illustrated in FIGS. 1 through 5, wherein like reference numerals refer to like components.

A herbicide in its solid or liquid state may be placed within a vessel (16), which in turn is fixed within a heating chamber (38) by a plurality of support braces (18). The upper port ion of the heating chamber (38) may be removed from the lower portion of this chamber in order that the herbicide may be introduced into the vessel (16), and the upper portion may then be latched to the lower portion when operation is to begin. A preferred embodiment of the invention uses a propane gas heater (14) shown connected to a propane supply tank (22) to raise the temperature of the herbicide such that it enters a gaseous state. A blower/compressor unit (12) is used to force air through the heating assembly (14), such that high temperature air then passes through the heating chamber (38) and causes the herbicide within the heating kettle (38) to boil. It is apparent that other means are available to heat the herbicide to the boiling point, such as electric heating coils within the heating chamber. A preferred embodiment of the invention uses the herbicide dichlobenil, which is initially in a solid state, but enters the gaseous state at approximately 140° C. The gaseous herbicide is then forced into a delivery tube (20) which has been placed down through a manhole (28) into a sewer line (26).

Figure 3:
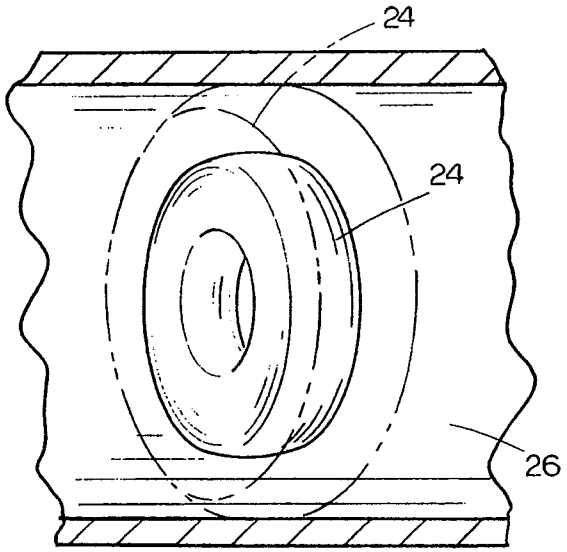
FIG. 3 is a cross-sectional view of a typical sewer line with an inflatable blocking device inserted therein.

FIG. 1 and FIG. 3 depict the use of inflatable blocking devices (24) which may be inserted into the sewer line and inflated so as to entrap the atmosphere of the particular section of sewer line to be treated. This herbicide-saturated atmosphere is then maintained for a period of one to three hours so as to allow sufficient time for the herbicide to be absorbed by the flora. As may be seen in FIG. 3, the inflatable blocking device of the preferred embodiment is similar to a common inner tube in that it has an aperture through which the delivery tube (20) may be inserted. The aperture of the inflatable blocking device also functions to prevent the sewer line from becoming overpressurized which would impede the input of the gaseous herbicide.

Figure 2:
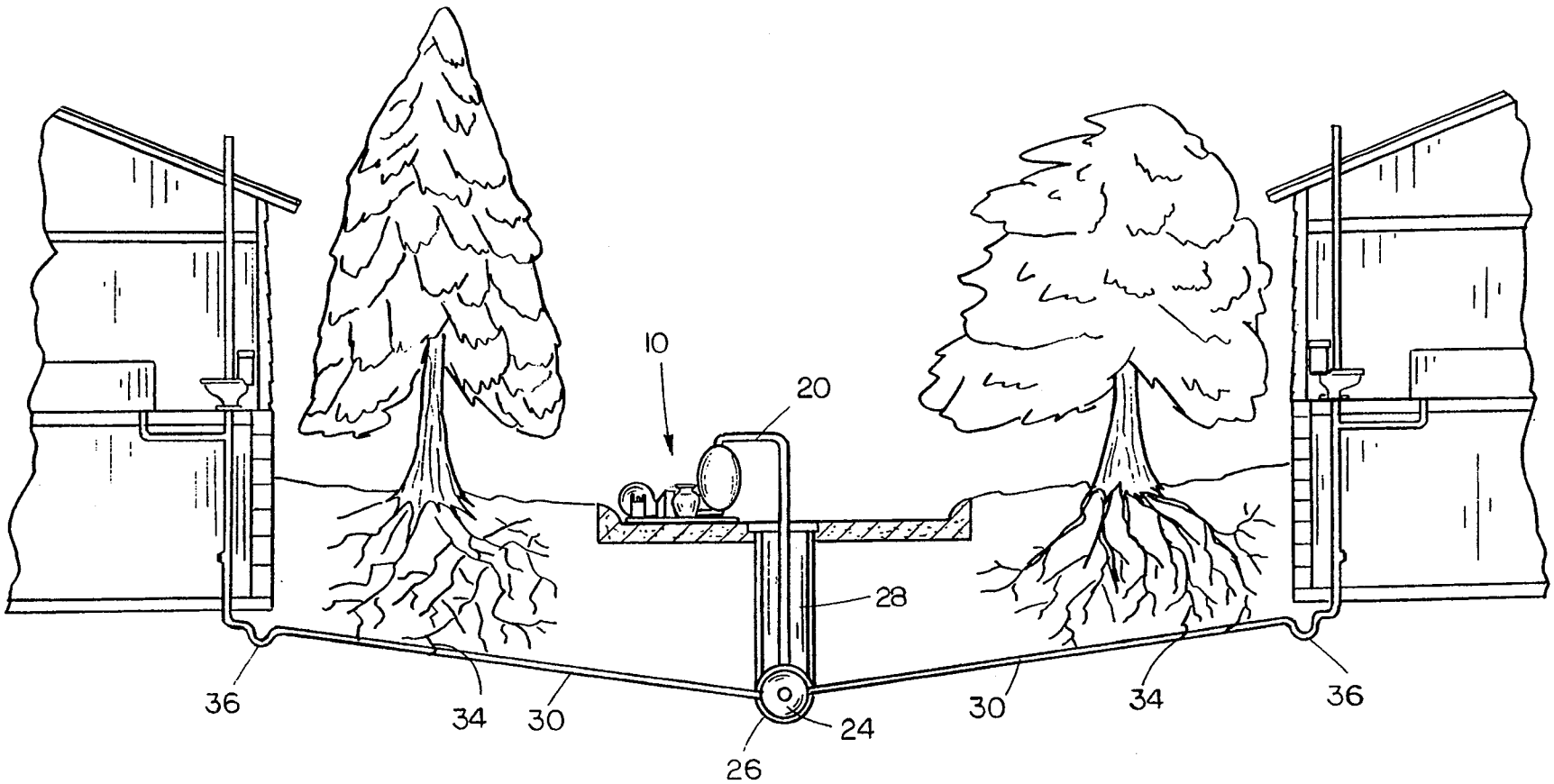
FIG. 2 is a cross-sectional view of a pair of sewer lines running from two homes to a main sewer line with the present invention installed therein.
Figure 4:
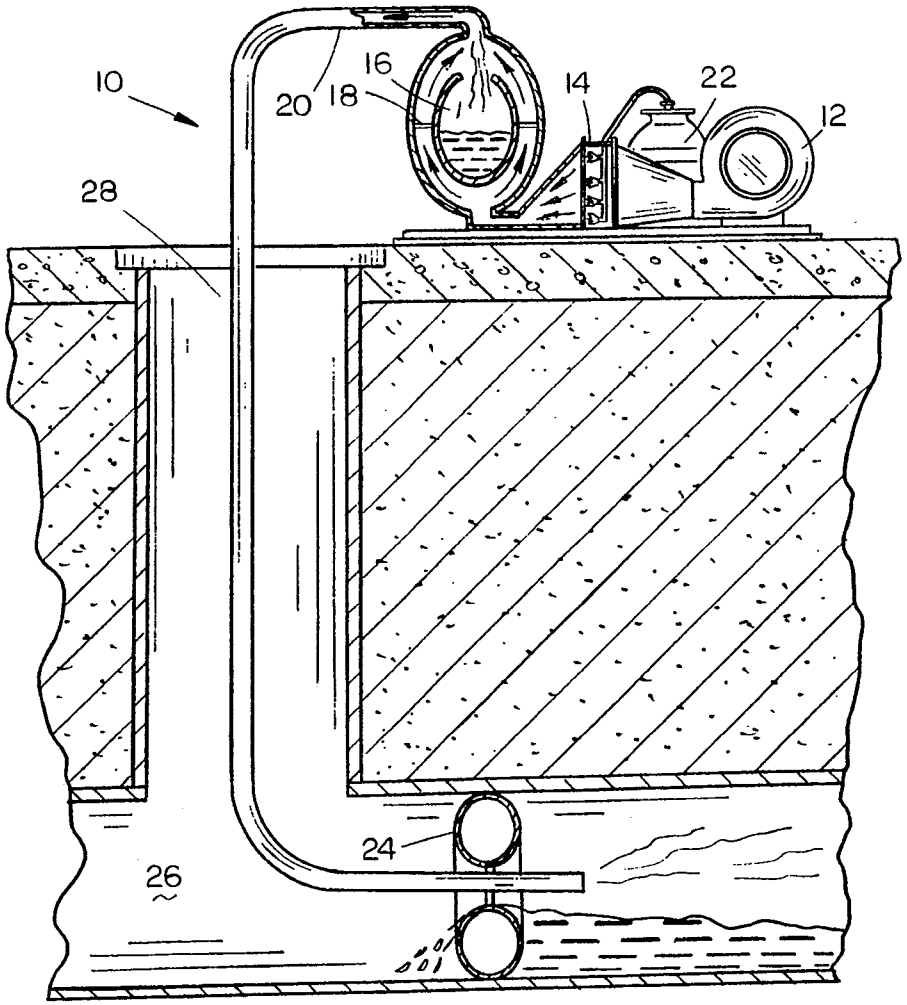
FIG. 4 is a cross-sectional view of a sewer line with the present invention in use.
Figure 5:
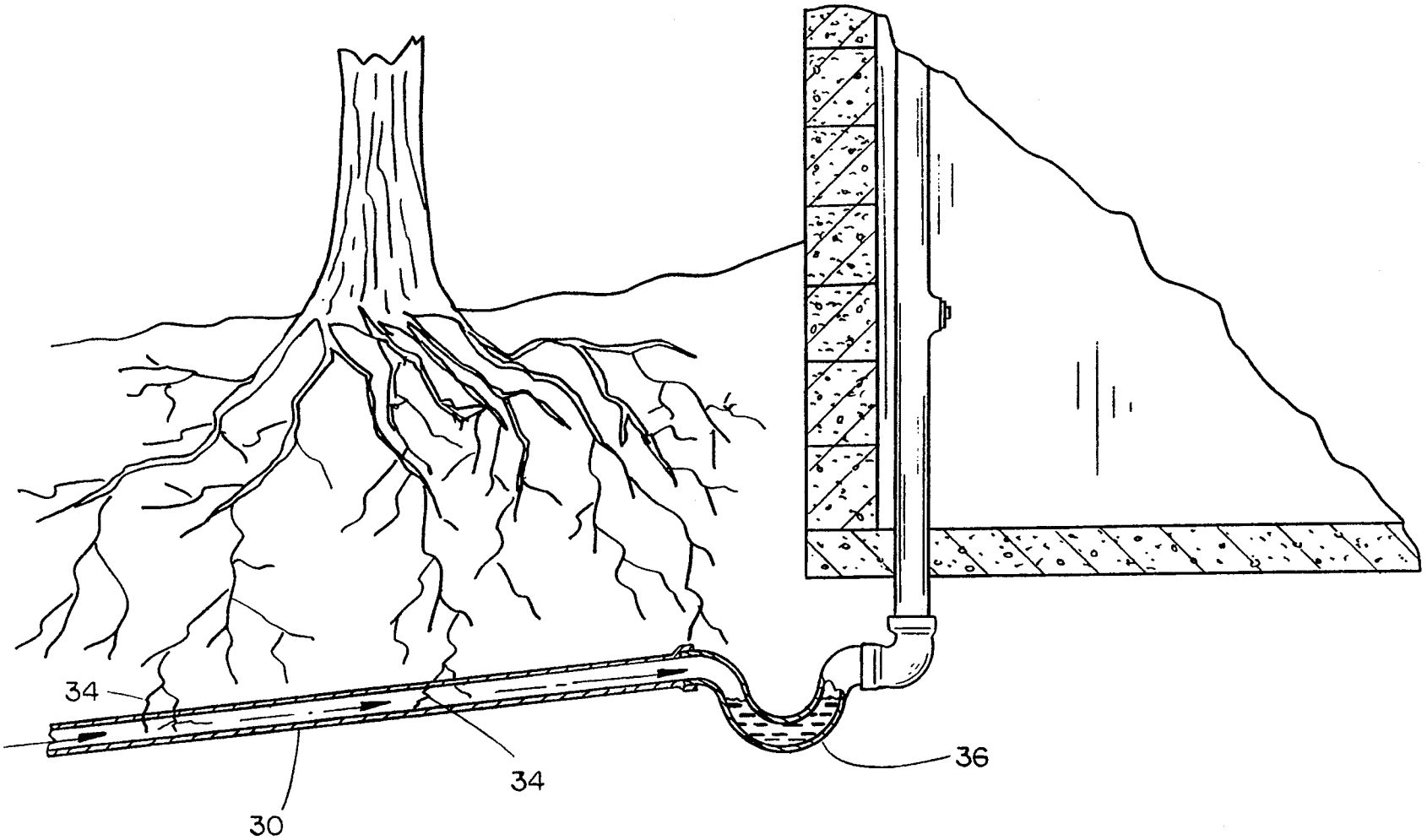
FIG. 5 is a cross-sectional view of a residential sewer line.

FIG. 2 and FIG. 5 depict a typical residential sewer line (30) which has been infested with tree roots (34). The gaseous herbicide will travel from the main line (26) and up the residential side line (30), but will be blocked from entering the residence by the P-trap (36).

Obviously, many modifications and variations of the present invention are possible in light of the above teachings. It is therefore to be understood that, within the scope of the appended claims, the invention may be practiced otherwise than as specifically described.

I claim:

1. A portable system for inhibiting the growth of flora within and about sewer lines, comprising:

(a) at least two flow restrictors fiat temporary installation at either end of an area of sewer line so as to define a treatment area, said flow restrictors adapted to limit the passage of both liquids and vapors between said treatment area; and (b) a portable herbicide injector, including:

(1) a compound which produces a phytocidally effective vapor upon heating;

(2) a vessel for heating said compound, said vessel having a vapor outlet port;

(3) a heater for heating said compound within said vessel; and (4) a flexible conduit having a first end connected to said vessel vapor outlet and a conduit vapor port for discharging phytocidally effective vapor into said treatment area such that said portable system may be utilized to inhibit the growth of flora within and about sewer lines.

2. The portable system for inhibiting the growth of flora of claim 1, further comprising a blower compressor unit operably connected to said injector for drawing said phytocidally effective vapor from said vessel through said conduit and into said treatment area.

3. The portable system for inhibiting the growth of flora of claim 1, wherein said flow restrictors are at least two inner tubes.

4. The portable system for inhibiting the growth of flora of claim 1, wherein said compound which produces a phytocidally effective vapor upon heating is dichlobenil.

5. The portable system for inhibiting the growth of flora of claim 4, wherein said compound is heated to approximately 140° C.

* * * * *